US005316447A

United States Patent [19]

Fujii et al.

[11] Patent Number: 5,316,447

[45] Date of Patent: May 31, 1994

[54] AXIAL MULTI-PISTON TYPE COMPRESSOR HAVING MOVABLE DISCHARGE VALVE ASSEMBLY

[75] Inventors: Toshiro Fujii; Koichi Ito; Kazuo Murakami; Kazuaki Iwama, all of Kariya, Japan

[73] Assignee: Kabushiki Kaisha Toyoda Jidoshokki Seisakusho, Kariya, Japan

[21] Appl. No.: 980,279

[22] Filed: Nov. 23, 1992

[30] Foreign Application Priority Data

Nov. 28, 1991 [JP] Japan ..... 3-314440

[51] Int. Cl.[5] ..... F04B 1/12; F04B 27/08; F01B 13/04

[52] U.S. Cl. ..... 417/269; 417/270; 91/472

[58] Field of Search ..... 417/269, 270, 271; 91/472, 486, 487

[56] References Cited

U.S. PATENT DOCUMENTS

| | | | |
|---|---|---|---|
| 4,813,852 | 3/1989 | Ikeda et al. | 417/269 |
| 4,911,614 | 3/1990 | Kawai et al. | 417/269 |
| 4,976,284 | 12/1990 | Hovarter | 417/269 |
| 5,032,060 | 7/1991 | Kobayashi et al. | 417/269 |
| 5,076,764 | 12/1991 | Kawai et al. | 417/269 |
| 5,100,306 | 3/1992 | Moran, Jr. et al. | 417/269 |
| 5,178,521 | 1/1993 | Ikeda et al. | 417/269 |
| 5,207,563 | 5/1993 | Ikeda et al. | 417/269 |

FOREIGN PATENT DOCUMENTS 59-115480 7/1984 Japan .

*Primary Examiner*—Richard A. Bertsch
*Assistant Examiner*—Alfred Basiches
*Attorney, Agent, or Firm*—Brooks Haidt Haffner & Delahunty

[57] ABSTRACT

A compressor comprises a cylinder block having cylinder bores formed radially spaced from and circumferentially distributed equidistantly about the cylinder longitudinal axis. Pistons are slidably received in the respective bores for reciprocation therein executing alternately suction and discharge strokes. The compressor also has a discharge valve assembly for controlling discharge of a compressed fluid from each of the bores into a discharge chamber, which assembly is axially movable between a first position in which the assembly is abutted against an end wall of the block and a second position in which the assembly is spaced from the end wall of the block to define a narrow space therebetween to interconnect the bores with each other. When the assembly is pushed toward the second position by the pressure of the compressed fluid during initial running of the compressor, bypass channels interconnect the cylinder with the discharge chamber.

10 Claims, 3 Drawing Sheets

AXIAL MULTI-PISTON TYPE COMPRESSOR HAVING MOVABLE DISCHARGE VALVE ASSEMBLY

BACKGROUND OF THE INVENTION

1) Field of the Invention

The present invention relates to an axial multi-piston type compressor for an air-conditioning system used in a vehicle such as an automobile.

2) Description of the Related Art

A swash plate type compressor is well known as representative of an axial Multi-piston type compressor, and comprises: front and rear cylinder blocks axially combined to form a swash plate chamber therebetween, the combined cylinder blocks each having the same number of cylinder bores radially formed therein and arranged with respect to the central axis thereof, the cylinder bores of the front cylinder block being aligned and registered with the cylinder bores of the rear cylinder block, respectively, with the swash plate chamber intervening therebetween; double-headed pistons slidably received in the pairs of aligned cylinder bores, respectively; front and rear housings fixed to front and rear end faces of the combined cylinder blocks through the intermediary of front and rear valve plate assemblies, respectively, the front and rear housings each forming a suction chamber and a discharge chamber together with the corresponding one of the front and rear valve plate assemblies; a rotatable shaft member arranged so as to be axially extended through the front housing and the combined cylinder blocks; and a swash plate member securely mounted on the shaft member within the swash plate chamber and engaging with the double-headed pistons to cause these pistons to be reciprocated in the pairs of aligned cylinder bores, respectively, by the rotation of the swash plate member.

The front and rear valve plate assemblies have substantially the same construction, in that each comprises: a disc-like member having sets of a suction port and a discharge port each set being able to communicate with the corresponding one of the cylinder bores of the front or rear cylinder block; an inner valve sheet attached to the inner side surface of the disc-like member and having suction reed valve elements formed integrally therein, each of which is arranged so as to open and close the corresponding suction port of the disc-like member; and an outer valve sheet attached to the outer side surface of the disc-like member and having discharge reed valve elements formed integrally therein, each of which is arranged so as to open and close the corresponding discharge port of the disc-like member. Each of the front and rear valve plate assemblies is also provided with suction openings aligned with passages formed in the front or rear cylinder block, respectively, whereby the suction chambers formed by the front and rear housings are in communication with the swash plate chamber into which a fluid or refrigerant is introduced from an evaporator of an air-conditioning system, through a suitable inlet port formed in the combined cylinder blocks.

In the swash plate type compressor as mentioned above, for example, the shaft member is driven by the engine of an automobile through a magnetic clutch, so that the swash plate member is rotated within the swash plate chamber, and the rotational movement of the swash plate member causes the double-headed pistons to be reciprocated in the pairs of aligned cylinder bores.

When each piston is reciprocated in the aligned cylinder bores, a suction stroke is executed in one of the aligned cylinder bores and a compression stroke is executed in the other cylinder bore. During the suction stroke, the suction reed valve element is opened and the discharge reed valve element is closed, whereby the refrigerant is delivered from the suction chamber to the cylinder bore through the suction port. During the compression stroke, the suction reed valve element concerned is closed and the discharge reed valve element concerned is opened, whereby the delivered refrigerant is compressed and discharged from the cylinder bore into the discharge chamber, through the discharge reed valve element.

In the compressor as mentioned above, as soon as the magnetic clutch is engaged to operationally connect the compressor to the engine of an automobile, the compressor is run at full capacity so that the engine is suddenly subjected to a large load from the compressor. Accordingly, a driver of the automobile has an uncomfortable feeling when the engine bears the sudden large load. Also, the magnetic clutch is subjected to damage due to the sudden large load, and thus it is prematurely deteriorated. Furthermore, when a part of the refrigerant remains as a liquid phase in the cylinder bores, not only can a noise be generated at an initial running of the compressor, but also the pistons and the valve elements may be subjected to damage.

Japanese Unexamined Patent Publication (Kokai) No. 59(1984)-115480 discloses a swash plate type compressor which is constructed such that the engine of an automobile can be prevented from being subjected to a sudden large load when engaging a magnetic clutch for operationally connecting the compressor to the engine. In particular, a bypass passage is formed in the cylinder block for communicating the cylinder bore with the suction chamber, and a spool valve is incorporated into the bypass passage to be moved by a differential pressure between the suction chamber and the discharge chamber. At an initial running of the compressor, the spool valve is resiliently biased to an open position so that a part of the compressed refrigerant is returned to the suction chamber through the bypass passage, and the remaining part thereof is discharged into the discharge chamber through the discharge reed valve. As the pressure of the discharge chamber becomes higher, the spool valve is moved from the open position toward a closed position due to a differential pressure established between the discharge and suction chambers. As soon as the bypass passage is closed by the spool valve, the compressor is run at full capacity. Accordingly, the engine of an automobile can be prevented from being subjected to a large load at the initial running of the compressor. Nevertheless, the compressor cannot be smoothly coupled to the engine because the bypass passage is suddenly closed by the spool valve. Accordingly, a driver of the automobile may have an uncomfortable feeling when closing the bypass passage, and the magnetic clutch may be subjected to damage due to the sudden closing of the bypass passage.

SUMMARY OF THE INVENTION

An object of the present invention is to provide a multi-piston type compressor constructed so as to be smoothly coupled to the engine of an automobile.

In accordance with the present invention, there is provided an axial multi-piston compressor comprising a cylinder block body having a plurality of cylinder bores formed radially and circumferentially therein with respect to a central axis thereof and spaced from each other at regular intervals, a plurality of pistons slidably received in the cylinder bores, respectively, to be reciprocated therein to execute alternately a suction stroke and a discharge stroke in such a manner that an execution of the suction and discharge strokes is successively carried out in the cylinder bores, a suction valve means for delivering a fluid to be compressed from a suction chamber to each of the cylinder bores during the suction stroke, and a discharge valve means for discharging a compressed fluid from each of the cylinder bores into a discharge chamber during the compression stroke. The discharge valve means is axially movable between a first position in which the discharge valve means is abutted against an end wall face of the cylinder block body and a second position in which the discharge valve means is spaced from the end wall face of the cylinder block body to define a narrow space therebetween to communicate the cylinder bores with each other, and is pushed away toward the second position due to a pressure of the compressed fluid at an initial running of the compressor. When the discharge valve means is at the second position, a small part of the compressed fluid is discharged into the discharge chamber though the discharge valve means, and the remaining major part thereof is introduced into the narrow space to be supplied to the cylinder bores in the suction stroke is executed. With this arrangement, the discharge valve means is gradually moved from the second position toward the first position in accordance with an increment in a pressure of the discharge chamber. Thus, the compressor can be smoothly coupled to the engine of a vehicle such as an automobile, and then can be run at full power.

The compressor may further comprise a bypass means for bypassing a part of the fluid introduced into the narrow space around the discharge valve means to the discharge chamber, and the bypass means is ineffective when the discharge valve means is at the first position.

The discharge valve means may include a plate member having recesses formed therein and disposed to be encompassed by end openings of the cylinder bores, respectively, and floating discharge valve elements movably trapped in the recesses, respectively, a discharge port being formed in a bottom of each recess. Also, the discharge valve means may include a plate member having discharge ports formed therein and disposed to be encompassed by end openings of the cylinder bores, respectively, and discharge reed valve elements attached to the plate member to cover the discharge ports, respectively.

Preferably, the compressor comprises a shaft member extending through the cylinder block body along the central axis thereof, and a swash plate member fixed on the shaft member and engaged with the pistons to convert a rotational movement of the shaft member into the reciprocation of the pistons. The suction chamber may be formed as a chamber for receiving the swash plate member. In this case, the suction valve means includes a floating suction valve element movably trapped in a recess formed in a head end face of each piston, and a head portion of each piston has a cavity formed therein and communicated with the suction chamber, a suction port being formed in a bottom of the recess and being opened to the cavity.

Also, the suction valve means may include a plate member having suction ports formed therein and disposed to be encompassed by end openings of the cylinder bores, respectively, and suction reed valve elements attached to the plate member to cover the suction ports, respectively.

BRIEF DESCRIPTION OF THE DRAWINGS

The other objects and advantages of the present invention will be better understood from the following description, with reference to the accompanying drawings, in which.

DESCRIPTION OF THE PREFERRED EMBODIMENTS

Figure 1:
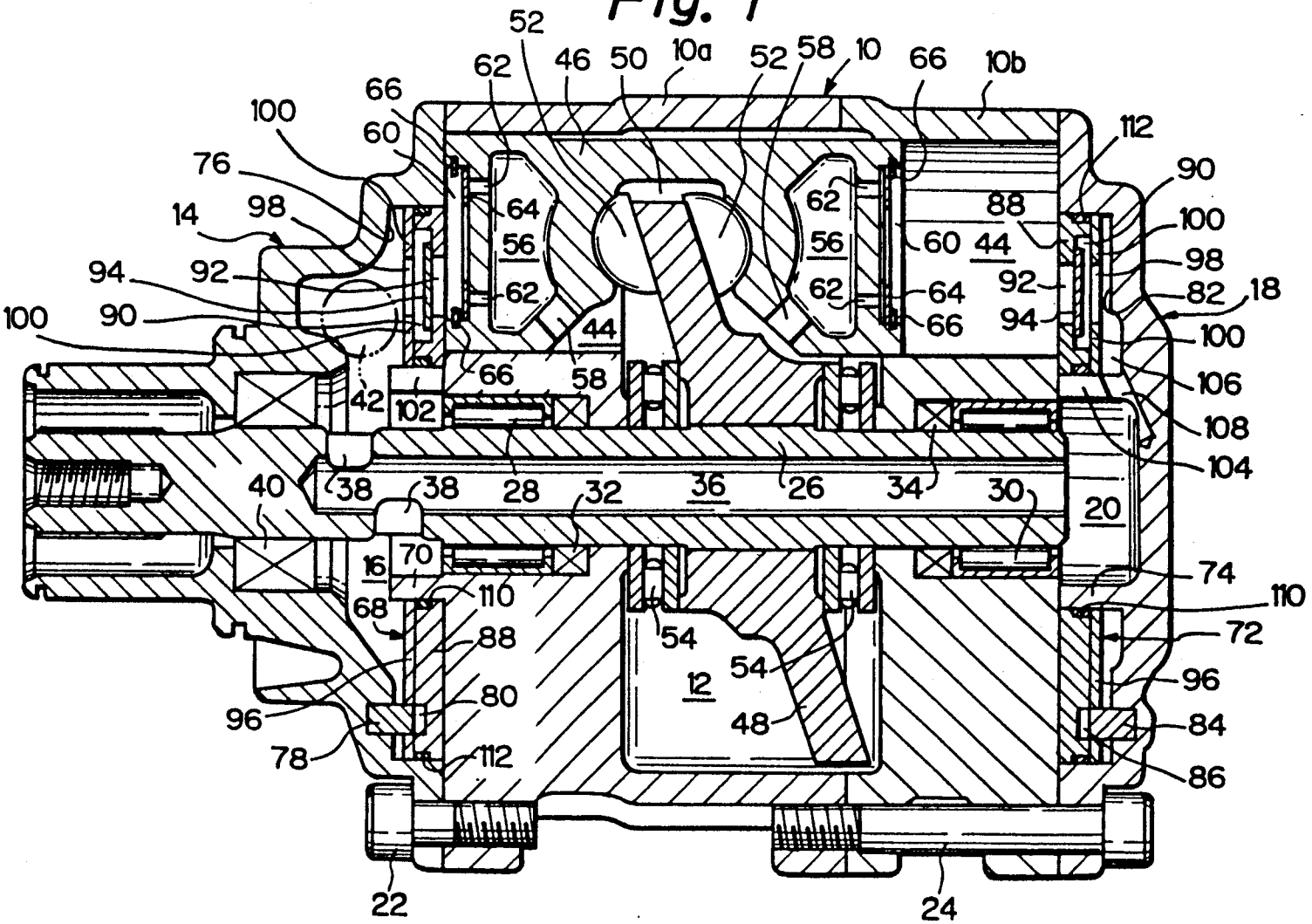
FIG. 1 is a longitudinal sectional view showing a swash plate type compressor according to the present invention.

FIG. 1 shows an axial multi-piston type compressor in which the present invention is embodied, and which may be used in an air-conditioning system (not shown) for a vehicle such as an automobile. The compressor comprises a cylinder block body 10 including front and rear cylinder blocks 10*a* and 10*b* axially combined to form a suction chamber 12 therebetween, a front housing 14 securely and hermetically joined to the front cylinder block 10*a* to form a discharge chamber 16 therebetween, and a rear housing 18 securely and hermetically joined to the rear cylinder block 10*b* to form a discharge chamber 20 therebetween. In this embodiment, the joining of the front housing 14 to the front cylinder block 10*a* is performed by screw bolts 22, only one of which is shown in FIG. 1, and the combination of the cylinder blocks 10*a* and 10*b* and the joining of the rear housing 18 to the rear cylinder block 10*b* are performed by bolts 24, only one of which is shown in FIG. 1.

A shaft member 26 is extended through the front and rear blocks 10*a* and 10*b*, and is rotatably supported by radial bearings 28 and 30 provided in recesses formed in the front and rear blocks 10*a* and 10*b* and opened to the discharge chambers 16 and 20, respectively. Two rotary seal units 32 and 34 are provided around the shaft member 26 in said recesses adjacent to the radial bearings 28 and 30, respectively, to thereby seal the suction chamber 12 from the discharge chambers 16 and 20. The shaft member 26 has an elongated bore 36 formed therein, which is opened to the discharge chamber 18 through radial holes 38 formed in the shaft member 26, and which is opened to the discharge chamber 20 at one end of the shaft member 26, as shown in FIG. 1, so that the discharge chambers 16 and 20 are in communication with each other through the elongated bore 36. The other end of the shaft member 26 is extended into a neck portion 14a integrally formed on the front housing 14 and opened to outside, and is adapted to be operatively connected to a prime mover of the vehicle through a suitable clutch such as a magnetic clutch (not shown) for rotation of the shaft member 26. A rotary seal unit 40 is provided around the shaft member 26 in the neck portion 14a of the front housing 14 to seal the discharge chamber 16 from the outside.

Note, the suction chamber 12 is in communication with an evaporator of an air-conditioning system through an inlet port (not shown) formed in the cylinder block 10, so that a fluid or refrigerant is supplied from the evaporator to the suction chamber 12, and the discharge chamber 16 is in communication with a condenser of the air-conditioning system through an outlet port 42 (shown by a phantom line in FIG. 1) formed in the front housing 14.

In this embodiment, each of the cylinder blocks 10a and 10b has five cylinder bores 44 formed radially and circumferentially therein with respect to the central axis thereof and spaced from each other at regular intervals, and the cylinder bores 44 of the front cylinder block 10a are aligned and registered with the cylinder bores 44 of the rear cylinder block 10b, respectively. Five double-headed pistons 46 are slidably received in the pairs of aligned cylinder bores 44 and 44, respectively, and are engaged with a swash plate member 48 securely mounted on the shaft member 26 within the suction chamber 12 to cause these pistons 46 to be reciprocated in the pairs of aligned cylinder bores 44 and 44, respectively, by a rotation of the swash plate member 48.

In particular, each of the pistons 46 has a slot 50 formed at a center thereof to receive the peripheral portion of the swash plate member 48, and two semi-spherical shoe elements 52, 52 are provided between the opposed sides of the peripheral portion of the swash plate member 48 and the opposite side walls of the slot 50, respectively. The opposite side walls of the slot 50 have a semi-spherical recess formed therein, the recess having a complementary relationship with the spherical surface of each shoe element 52. The spherical surface of each shoe element 52 is in slidable contact with the corresponding spherical recess, and the circular flat surface thereof is in slidable contact with the corresponding side face of the peripheral portion of the swash plate member 48. With this arrangement, each of the pistons 46 can be reciprocated in the corresponding aligned cylinder bores 44 and 44 of the cylinder blocks 10a and 10b by the rotation of the swash plate member 48. Since the swash plate member is subjected to a thrust force during the reciprocation of the pistons 46, a pair of thrust bearings 54, 54 are provided around the shaft member 26 and are disposed between the opposed sides of a central portion of the swash plate member 48 and the opposite inner sides of the cylinder blocks 10a and 10b.

In this embodiment, as shown in FIG. 1, each of the pistons 46 has two cavities 56 formed in the head end portions thereof, which are in communication with the suction chamber 12 through inlet openings 58 formed in the opposite side walls of the slot 50, respectively. Also, each piston 46 has two circular recesses 60 formed in the head end faces thereof, and at least two arcuate suction ports 62 are formed in a bottom of each circular recess 60 and are opened to the corresponding cavity 56. An annular floating suction valve element 64 is movably trapped in each circular recess 60 by at least two sector-shaped projections 66 implanted in an inner side wall of the circular recess 60. Namely, the floating suction valve element 64 is movable between a first position in which the element 64 is abutted against the bottom of the circular recess 60 to close the arcuate suction ports 62 and a second position in which the element 64 is abutted against the sector-shaped projections 66 to open the arcuate suction ports 62.

The compressor further comprises a front discharge valve assembly 68 slidably mounted on a sleeve portion 70 integrally projected from an outer end wall of the front cylinder block 10a and surrounding the shaft member 26, and a rear discharge valve assembly 72 slidably mounted on a sleeve portion 74 integrally projected from an inner wall of the rear housing 18. The front discharge valve assembly 68 is axially movable between a first position in which the assembly 68 is abutted against the outer end wall of the cylinder block 10a and a second position in which the assembly 68 is abutted against an inner annular wall 76 formed with the front housing 14, but is immovable about a central axis of the front cylinder block 10a due to the fact that a pin element 78 implanted in and projected from the inner annular wall 76 is slidably received in a hole 80 formed in the front discharge valve assembly 68. Similarly, the rear discharge valve assembly 72 is axially movable between a first position in which the assembly 72 is abutted against the outer end wall of the cylinder block 10b and a second position in which the assembly 72 is abutted against an inner annular wall 82 formed with the rear housing 18, but is immovable about a central axis of the rear cylinder block 10b due to the fact the a pin element 84 implanted in and projected from the inner annular wall 82 is slidably received in a hole 86 formed in the rear valve assembly 72. Note, the valve assembly 72 is shown at the first position in FIG. 1, and at the second position in FIG. 2.

Figure 2:
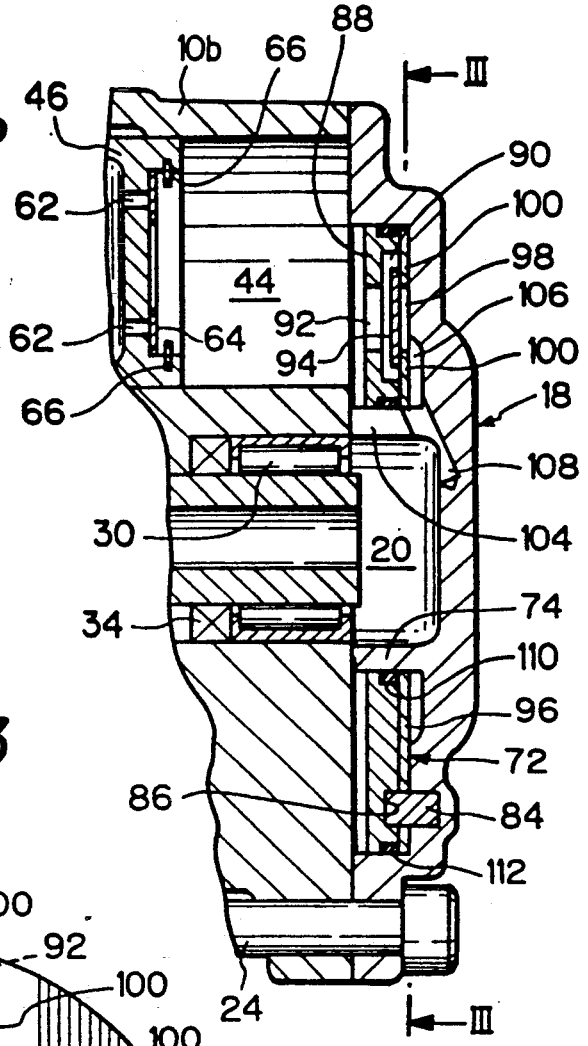
FIG. 2 is a partial view of FIG. 1, but a rear discharge valve assembly is at a position different from that shown in FIG. 1, the rear discharge valve assembly being sectioned along a line II—II of FIG. 3.

When the front discharge valve assembly 68 is at the second position in which the assembly 68 is abutted against the inner annular wall 76 of the front housing 14, a narrow space is defined between the outer end wall of the front cylinder block 10a and the inner wall face of the assembly 68, so that the cylinder bores 44 formed in the front cylinder block 10a are in communication with each other. Similarly, when the rear discharge valve assembly 72 is at the second position in which the assembly 72 is abutted against the inner annular wall 82 of the rear housing 18, a narrow space is defined between the outer end wall of the rear cylinder block 10b and the inner wall face of the assembly 72, as shown in FIG. 2, so that the cylinder bores 44 formed in the rear cylinder block 10b are in communication with each other.

Figure 3:
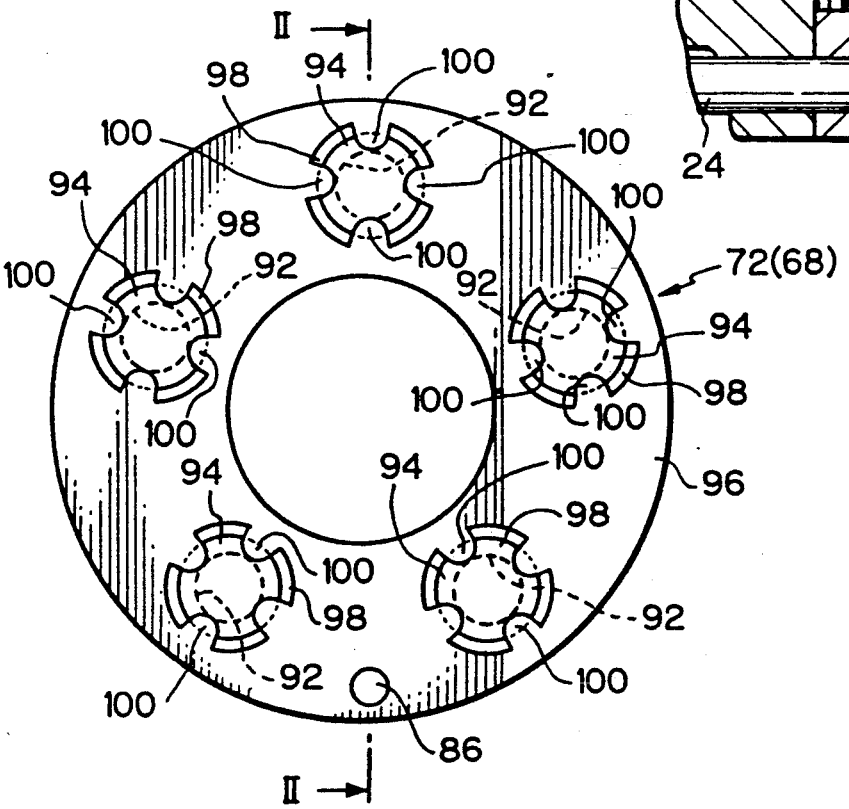
FIG. 3 is an end view showing a movable discharge valve assembly, observed along a line III—III of FIG. 2.

The front and rear discharge valve assemblies 68 and 72 are essentially identical to each other. Each valve assembly 68, 72 includes an annular plate member 88 having five circular recesses 90 formed radially and circumferentially therein with respect to the central axis thereof and spaced from each other at regular intervals, and these circular recesses 90 are arranged so as to be encompassed by five outer end openings of the cylinder bores 44, respectively. A discharge port 92 is formed in a bottom of each circular recess 90, and is opened to the corresponding bore 44. A disc-shaped floating discharge valve element 94 is movably trapped in each circular recess 60 by an annular retainer plate member 96 attached and fixed to the annular plate member 88. In particular, as shown in FIG. 3, the retainer plate member 96 has five cross-shaped openings 98 formed radially and circumferentially therein with respect to the central axis thereof and spaced from each other at regular intervals, and these cross-shaped openings 98 are arranged so as to be aligned with the five circular recesses 90, respectively. Namely, each cross-shaped opening 98 is formed in the retainer plate member 96 in such a manner that four tongue-shaped retainer elements 100 remain therein, and thus each of the discharge valve elements 94 is movably trapped in the corresponding circular recess 60 by the tongue-shaped retainer elements 100. The discharge valve element 94 is movable between a first position in which the element 94 is abutted against the bottom of the recess 90 to close the discharge port 92 and a second position in which the element is abutted against the tongue-shaped retainer elements 100 to open the discharge port 92.

The sleeve portion 70 of the front cylinder block 10*a* may have five restricted slit passages 102 formed radially and circumferentially therein with respect to the central axis thereof and spaced from each other at regular intervals, and these slit passages 102 are arranged so as to be adjacent to the cylinder bores 44, respectively, so that the discharge chamber 16 is in communication with the cylinder bores 44 through the slit passages 102 when the front discharge valve assembly 68 is moved from the first position to the second position. Similarly, the sleeve portion 74 of the rear housing 18 may have five restricted slit passages 104 formed radially and circumferentially therein with respect to the central axis thereof and spaced from each other at regular intervals, and these slit passages 104 are arranged so as to be adjacent to the cylinder bores 44, respectively, so that the discharge chamber 20 is in communication with the cylinder bores 44 through the slit passages 104 when the rear discharge valve assembly 72 is moved from the first position in which the assembly 72 is abutted against the outer end wall of the cylinder block 10*b* to the second position in which the assembly 72 is abutted against the inner annular wall 82 of the rear housing 18. As shown in FIG. 1 and 2, an annular recess 106 is formed in the inner wall of the rear housing 18 and just inside of the annular wall 82 thereof, and is in communication with the discharge chamber 20 through at least one bore 108 formed in the sleeve portion 74. Note, in FIG. 1 and 2, reference numerals 110 and 112 indicate an inner annular seal element and an outer annular seal element incorporated in an inner annular wall and an outer annular wall of the valve assembly 68, 72, respectively.

In operation, the shaft member 26 is driven by the engine of a vehicle, such as an automobile, so that the swash plate member 48 is rotated within the swash plate chamber or suction chamber 12, and the rotational movement of the swash plate member 48 causes the double-headed pistons 46 to be reciprocated in the pairs of aligned cylinder bores 44. When each piston 46 is reciprocated in the aligned cylinder bores 44, a suction stroke is executed in one of the aligned cylinder bores 44 and a compression stroke is executed in the other cylinder bore. During the suction stroke, the annular floating suction valve element 64 concerned is at the second position or open position to open the arcuate suction ports 62, so that a refrigerant is delivered from the suction chamber 12 to the cylinder bore 44 through the inlet openings 58, the cavity 56, and the arcuate suction ports 62.

During the compression stroke, the suction valve element 64 concerned is moved from the second position or open position to the first position or closed position to close the arcuate suction ports 62, so that the delivered refrigerant is compressed to cause a rise in the pressure thereof. Accordingly, the disc-shaped floating discharge valve element 94 is moved from the first position or closed position to the second position of open position. At the same time, the front movable discharge valve assembly 68 is pushed away toward the second position in which the assembly 68 is abutted against the inner annular wall 76 of the front housing 14, so that the cylinder bores 44 formed in the front cylinder block 10*a* are in communication with each other through the narrow space defined between the outer end wall of the front cylinder block 10*a* and the inner wall face of the assembly 68, and the rear movable discharge valve assembly 72 also is pushed away toward the second position in which the assembly 72 is abutted against the inner annular wall 82 of the rear housing 18, so that the cylinder bores 44 formed in the front cylinder block 10*b* are in communication with each other through the narrow space defined between the outer end wall of the rear cylinder block 10*b* and the inner wall face of the assembly 72. Note, in the beginning of operation, the pressure of the discharge chamber 16, 20 is low and is equal to that of the suction chamber 12. Thus, a small part of the compressed refrigerant is discharged into the discharge chamber 16, 20 through the discharge port 92, but the remaining major part of the compressed refrigerant is introduced into said narrow space. A part of the refrigerant introduced into the narrow space is bypassed around the discharge port 92 to the discharge chamber 16, 20 through the slit passages 102, 104, and the other part thereof is supplied to the cylinder bores 44 in which the suction stroke is executed. Note, when the slit passages 102, 104 are not provided in the sleeve portion 70, 74, the remaining major part of the compressed refrigerant is supplied to the cylinder bores 44 in which the suction stroke is executed. Preferably, various design parameters such as a size of the slit passages 102, 104, a diameter of the discharge port 92, a distance between the first and second positions of the movable valve assembly 68, 72, etc., are selected such that the small part of the compressed refrigerant discharged into the discharge chamber 16, 20 through the discharge port 92 is about 10% of the total volume.

As the pressure of the discharge chamber 16, 20 is raised, the valve assembly 68, 72 is gradually moved from the second position toward the first position in which the assembly 68, 72 is abutted against the outer end wall of the cylinder block 10*a*, 10*b*, because the pressure of the discharge chamber 16, 20 cannot be sufficiently exerted upon the inner wall face of the valve assembly 68, 72 due to the restriction of the slit passages 102, 104. Of course, as soon as the valve assembly 68, 72 reaches the first position, operation of the compressor is performed at full power. Preferably, the design parameters as mentioned above are selected such that it takes at least one second until the valve assembly 68, 72 is moved from the second position to the first position, whereby a smooth coupling can be achieved between the compressor and the engine of a vehicle.

Figure 4:
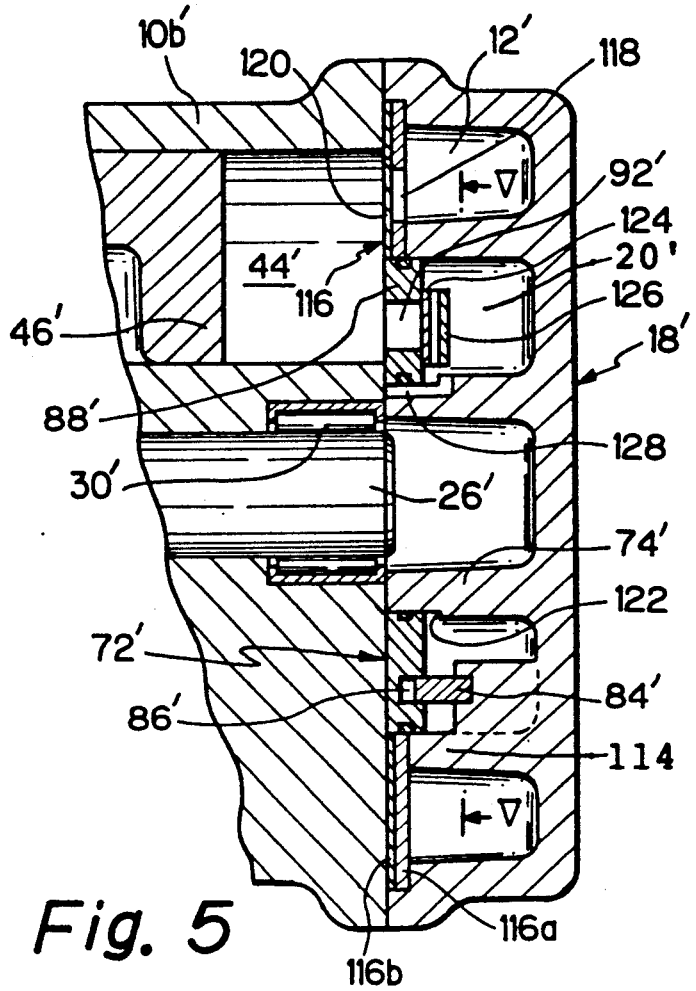
FIG. 4 is a partial view corresponding to FIG. 2, showing a second embodiment of a swash plate type compressor according to the present invention, a rear discharge valve assembly being sectioned along a line IV—IV of FIG. 3.
Figure 5:
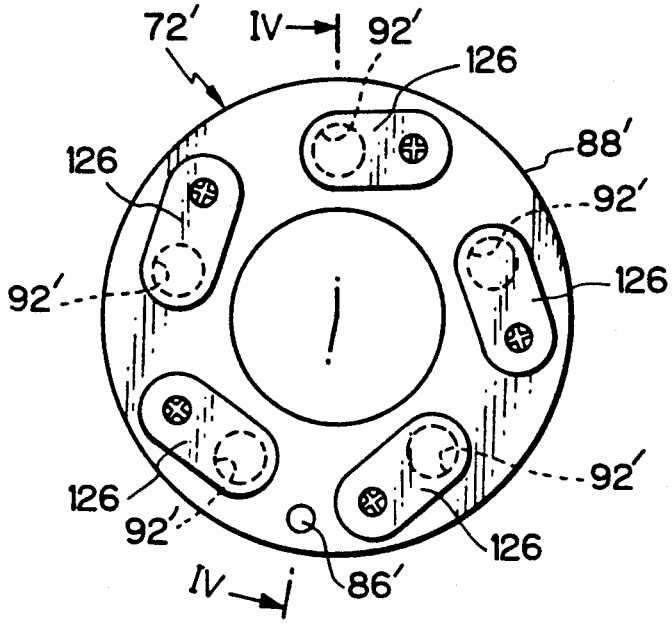
FIG. 5 is an end view showing a movable discharge valve assembly, observed along a line V—V of FIG. 4.

FIGS. 4 and 5 show a second embodiment of a compressor according to the present invention. Although only a rear portion of the compressor is illustrated in FIG. 4, this compressor is constructed in substantially the same manner as shown in FIG. 1 except for the matters stated hereinafter.

In the second embodiment, a rear housing 18' has an annular partition wall 114 integrally projected from the inner wall thereof, and a sleeve portion 74' integrally projected from the inner wall thereof and concentrically displaced inside of the partition wall 114. The rear housing 18' is securely and hermetically joined to an outer end wall of a rear cylinder block **10*b'*, as shown in FIG. 4, so that an annular suction chamber 12' and an annular discharge chamber 20' are defined between the outer side wall of the rear housing 18' and the partition wall 114 and between the partition wall 114 and the sleeve portion 74', respectively. A rear suction valve assembly 116 is fixedly provided between the rear cylinder block 10*b'* and the rear housing 18', and includes an annular plate member 116*a* and an annular metal sheet 116*b* attached thereto. The Plate member 116*a* has five suction ports 118 arranged radially and circumferentially therein and spaced from each other at regular intervals, and these suction ports 118 are arranged so as to be encompassed by outer end openings of five cylinder bores 44' formed in the rear cylinder block 10*b'*, respectively. The metal sheet 116*b*, which may be made of spring steel, phosphor bronze, or the like, has five suction reed valve elements 120 formed integrally therewith and arranged radially and circumferentially to be in register with the discharge ports 118, respectively, whereby each of the discharge reed valve elements 120 can be moved so as to open and close the corresponding discharge port 118**, due to a resilient property thereof.

A rear discharge valve assembly 72' is slidably mounted on the sleeve portion 74' of the rear housing 18', and is concentrically disposed inside the rear suction valve assembly 116. The discharge valve assembly 72' is axially movable between a first position in which the assembly 72' is abutted against the outer end wall of the cylinder block **10*b'* and a second position in which the assembly 72' is abutted against an annular shoulder 122 formed in the sleeve portion 74', but is immovable rotatably about a central axis of the rear cylinder block 10*b'* due to the fact that a pin element 84' implanted in and projected from the rear housing 18' is slidably received in a hole 86' formed in the rear valve assembly 72'. When the rear discharge valve assembly 72' is at the second position in which the assembly 72' is abutted against the annular shoulder 122 of the sleeve portion 74', a narrow space is defined between the outer end wall of the rear cylinder block 10*b'* and the inner wall face of the assembly 72', so that the cylinder bores 44' formed in the rear cylinder block 10*b'* are in communication with each other. The discharge valve assembly 72' includes an annular plate member 88' having five discharge ports 92' arranged and circumferentially therein with respect to the central axis thereof and spaced from each other at regular intervals, as shown in FIG. 5, and these discharge ports 92' are arranged so as to be encompassed by the outer end openings of the cylinder bores 44', respectively. Five sets of a discharge reed valve element 124 and a retainer plate element 126 are attached to the annular plate member 88' to cover the discharge ports 92' formed therein, respectively, as shown in FIG. 5**.

The sleeve portion 74' of the rear housing 18' may have five restricted grooves 128 arranged radially and circumferentially therein with respect to the central axis thereof and spaced from each other at regular intervals, and these grooves 128 are arranged so as to be adjacent to the cylinder bores 44', respectively, so that the discharge chamber 20' is in communication with the cylinder bores 44' through the grooves 128 when the rear valve assembly 72' is moved from the first position in which the assembly 72' is abutted against the outer end wall of the rear cylinder block **10*b'* to the second position in which the assembly 72' is abutted against the annular shoulder 122 of the sleeve portion 74'**.

Although not shown in FIG. 4, the compressor comprises a front cylinder block, a front housing, an immovable suction valve assembly, and a movable discharge valve assembly corresponding to the rear cylinder block **10*b'*, the rear housing 18', the immovable suction valve assembly 116, and the movable discharge valve assembly 72'. A double-headed piston 46' is slidably received in each pair of aligned cylinder bores of the front and rear cylinder blocks, and is slidably engaged with a swash plate member fixed on a shaft member 26', to cause the piston 46' to be reciprocated in each pair of the aligned cylinder bores by a rotation of the swash plate member. Note, reference 30' indicates a radial bearing for rotatably supporting the shaft member 26'**.

In the second embodiment as shown in FIG. 4, during a suction stroke, the suction reed valve element (120) is opened so that a refrigerant is delivered from the suction chamber (12') to the cylinder bore (44') through the suction port (118). During a compression stroke, the suction valve element (120) is closed, and the delivered refrigerant is compressed to cause a rise in the pressure thereof. Accordingly, the discharge reed valve element (124) is opened, and the movable valve assembly (72') is pushed away toward the second position in which the assembly (72') is abutted against the annular shoulder (122), so that the cylinder bores (44') are in communication with each other through the narrow space defined between the outer end wall of the rear cylinder block **(10*b'*) and the inner wall face of the assembly (72'). Note, in the beginning of operation, the pressure of the discharge chamber (20') is low and is equal to that of the suction chamber (12'). Thus, a small part of the compressed refrigerant is discharged into the discharge chamber (20') through the discharge port (92'), but the remaining major part of the compressed refrigerant is introduced into the narrow space between the outer end wall of the rear cylinder block (10*b'*) and the inner wall face of the assembly (72'). A part of the refrigerant introduced into the narrow space is bypassed around the discharge port (92') to the discharge chamber (20') through the grooves (128), and the other part thereof is supplied to the cylinder bores (44') in which the suction stroke is executed. Note, when the grooves (128) are not provided in the sleeve portion (74'), the remaining major part of the compressed refrigerant is supplied to the cylinder bores 44 in which the suction stroke is executed. As the pressure of the discharge chamber (20') is raised, the valve assembly (72') is gradually moved from the second position toward the first position in which the assembly (72') is abutted against the outer end wall of the cylinder block (10*b'*) for the same reason as the first embodiment shown in FIGS. 1 and 2. As soon as the valve assembly (72')** reaches the first position, operation of the compressor is performed at full power. Thus, a smooth coupling can be achieved between the compressor and the engine of a vehicle.

In the embodiments as mentioned above, although the compressor includes a cylinder block body in which the cylinder bores are disposed at the sides of the swash plate member, it should be understood by those skilled in the art that the present invention may be applied to a multi-piston type compressor including a cylinder block body having cylinder bores formed at only one side of a swash plate member.

Finally, it will be understood by those skilled in the art that the foregoing description is of preferred embodiments of the disclosed compressor, and that various changes and modifications may be made to the present invention without departing from the spirit and scope thereof.

What is claimed is:

1. An axial multi-piston compressor comprising:

a cylinder block body having a plurality of cylinder bores formed radially outward from and disposed circumferentially equidistantly about a central axis thereof;

a plurality of pistons slidably received in said cylinder bores, respectively, to be reciprocated therein to execute alternately a suction stroke and a discharge stroke;

suction valve means for controlling the delivery of a fluid to be compressed from a suction chamber to each of said cylinder bores during the suction stroke; and a discharge valve assembly for controlling the discharge of a compressed fluid from each of said cylinder bores into a discharge chamber during the compression stroke, wherein said discharge valve assembly is axially movable between a first position in which said discharge valve assembly is abutted against an end wall face of said cylinder block body and a second position in which said discharge valve assembly is spaced from said end wall face of said cylinder block body to define a narrow space therebetween to communicate said cylinder bores with each other, and is pushed away toward said second position due to the pressure of the compressed fluid during initial running of the compressor; and wherein, means are provided such that when said discharge valve assembly is at said second position, a small part of the compressed fluid is discharged into said discharge chamber through the discharge valve assembly, and the remaining major part thereof is introduced into said narrow space to be supplied to the cylinder bores in which a suction stroke is being executed, whereby said discharge valve assembly is gradually moved from said second position toward said first position in response to increase in the pressure of said discharge chamber.

2. An axial multi-piston compressor as set forth in claim 1, wherein said discharge valve assembly includes a plate member having recesses formed therein and disposed to be encompassed by end openings of said cylinder bores, respectively, and floating discharge valve elements movably trapped in said recesses, respectively, a discharge port being formed in a bottom of each recess.

3. An axial multi-piston compressor as set forth in claim 1, wherein said discharge valve assembly includes a plate member having discharge ports formed therein and disposed to be encompassed by end openings of said cylinder bores, respectively, and discharge reed valve elements attached to said plate member to cover said discharge ports, respectively.

4. An axial multi-piston compressor as set forth in claim 1, further comprising a shaft member extending through said cylinder block body along the central axis thereof, and a swash plate member fixed on said shaft member and engaged with said pistons to convert a rotational movement of said shaft member into the reciprocation of said pistons, said suction chamber being formed as a chamber for receiving said swash plate member, said suction valve means including a floating suction valve element movably trapped in a recess formed in a head end face of each piston, a head portion of each piston having a cavity formed therein and communicated with the suction chamber, a suction port being formed in a bottom of said recess and being opened to said cavity.

5. An axial multi-piston compressor as set forth in claim 1, wherein said suction valve means includes a plate member having suction ports formed therein and disposed to be encompassed by end openings of said cylinder bores, respectively, and suction reed valve elements attached to said plate member to cover said suction ports, respectively.

6. An axial multi-piston compressor as set forth in claim 1, further comprising bypass assembly for bypassing a part of the fluid introduced into said narrow space around said discharge valve means to said discharge chamber, said bypass means being ineffective when said discharge valve means is at said first position.

7. An axial multi-piston compressor as set forth in claim 6, wherein said discharge valve assembly includes a plate member having recesses formed therein and disposed to be encompassed by end openings of said cylinder bores, respectively, and floating discharge valve elements movably trapped in said recesses, respectively, a discharge port being formed in a bottom of each recess.

8. An axial multi-piston compressor as set forth in claim 6, wherein said discharge valve assembly includes a plate member having discharge ports formed therein and disposed to be encompassed by end openings of said cylinder bores, respectively, and discharge reed valve elements attached to said plate member to cover said discharge ports, respectively.

9. An axial multi-piston compressor as set forth in claim 6, further comprising a shaft member extending through said cylinder block body along the central axis thereof, and a swash plate member fixed on said shaft member and engaged with said pistons to convert a rotational movement of said shaft member into the reciprocation of said pistons, said suction chamber being formed as a chamber for receiving said swash plate member, said suction valve means including a floating suction valve element movably trapped in a recess formed in a head end face of each piston, a head portion of each piston having a cavity formed therein and communicated with the suction chamber, a suction port being formed in a bottom of said recess and being opened to said cavity.

10. An axial multi-piston compressor as set forth in claim 6, wherein said suction valve means includes a plate member having suction ports formed therein and disposed to be encompassed by end openings of said cylinder bores, respectively, and suction reed valve elements attached to said plate member to cover said suction ports, respectively.

* * * * *

UNITED STATES PATENT AND TRADEMARK OFFICE

CERTIFICATE OF CORRECTION

PATENT NO. : 5,316,447
DATED : May 31, 1994
INVENTOR(S) : Fujii et al

It is certified that error appears in the above-indentified patent and that said Letters Patent is hereby corrected as shown below:

Column 9, line 51, after "arranged" insert --radially--.

Column 11, line 50, after "pressure" change "of" to --in--.

Column 12, line 24, change "assembly" to --means--; line 26 change "means" to --assembly--; line 28, change "means" to --assembly--.

Signed and Sealed this

Eighth Day of November, 1994

Bruce Lehman

*Attest:*

BRUCE LEHMAN

*Attesting Officer*

*Commissioner of Patents and Trademarks*